US005671652A

United States Patent [19]

Weyer

[11] Patent Number: 5,671,652

[45] Date of Patent: Sep. 30, 1997

[54] ROTARY ACTUATOR

[75] Inventor: Dean R. Weyer, Enumclaw, Wash.

[73] Assignee: 1994 Weyer Family Limited Partnership, Enumclaw, Wash.

[21] Appl. No.: 700,072

[22] Filed: Aug. 20, 1996

[51] Int. Cl.[6] ..... F01B 3/00

[52] U.S. Cl. ..... 92/33; 92/31; 92/107

[58] Field of Search ..... 92/31, 32, 33, 92/107, 108

[56] References Cited

U.S. PATENT DOCUMENTS

| | | | |
|---|---|---|---|
| 2,225,790 | 12/1940 | Nardone | 92/33 |
| 2,970,574 | 2/1961 | Geyer | 92/107 |
| 3,393,610 | 7/1968 | Aarvold | 92/33 |
| 4,152,972 | 5/1979 | Fylling | 92/33 |
| 4,313,367 | 2/1982 | Weyer | 92/33 |
| 4,683,767 | 8/1987 | Weyer | 74/409 |
| 4,741,250 | 5/1988 | Weyer | 92/33 |
| 4,838,103 | 6/1989 | Weyer | 74/89.15 |
| 4,846,007 | 7/1989 | Weyer | 74/89.15 |
| 4,881,419 | 11/1989 | Weyer | 74/89.15 |
| 4,906,161 | 3/1990 | Weyer | 414/705 |
| 5,038,672 | 8/1991 | Beuschau | 92/33 |
| 5,054,372 | 10/1991 | Weyer | 92/13.5 |
| 5,267,504 | 12/1993 | Weyer | 92/31 |

FOREIGN PATENT DOCUMENTS

| | | | |
|---|---|---|---|
| 1426525 | 5/1969 | Germany | 92/33 |

*Primary Examiner*—Thomas E. Denion
*Attorney, Agent, or Firm*—Seed and Berry LLP

[57] ABSTRACT

A fluid powered rotary actuator having a body with first and second ends. The body has a generally cylindrical interior sidewall with a grooved, inwardly facing circumferential portion. The body is adapted for coupling to a first external member. A drive member extends generally coaxially within the body and is supported for rotation relative thereto. The drive member has an end flange positioned toward the body first end adapted for coupling to a second external member, and a shaft rigidly attached to the end flange. The shaft has a grooved, outwardly facing circumferential sidewall portion positioned within the body toward the body second end and a smooth, outwardly facing circumferential sidewall portion positioned within the body between the end flange and the shaft groove sidewall portion. The end flange extends laterally outward beyond the shaft smooth sidewall portion and the shaft grooved sidewall portion has an outer diameter equal to or less than the outer diameter of the shaft smooth sidewall portion. The shaft grooved sidewall portion is formed as an integral part of the shaft, and the end flange as an integral unit with the shaft. The actuator further includes an annular piston sleeve positioned within the body and having a central aperture receiving the shaft therethrough. The piston sleeve is mounted for reciprocal axial movement within the body in response to selective application of pressurized fluid to a piston portion thereof in sliding sealed engagement with the shaft and body smooth sidewall portions to define fluid compartments to each side thereof. The sleeve portion has a grooved, inwardly facing circumferential sidewall portion engaging the shaft grooved sidewall portion, and a grooved, outwardly facing circumferential sidewall portion engaging the body grooved sidewall portion as the piston sleeve reciprocally moves within the body to translate axial movement of the piston sleeve into rotation of the drive member.

14 Claims, 4 Drawing Sheets

ROTARY ACTUATOR

TECHNICAL FIELD

The present invention relates generally to actuators, and more particularly, to fluid-powered rotary actuators in which axial movement of a piston results in relative rotational movement between a body and an output shaft.

BACKGROUND OF THE INVENTION

Rotary helical splined actuators have been employed in the past to achieve the advantage of high-torque output from a simple linear piston-and-cylinder drive arrangement. The actuator typically uses a cylindrical body with an elongated rotary output shaft extending coaxially within the body, with an end portion of the shaft providing the drive output. An elongated annular piston sleeve has a sleeve portion splined to cooperate with corresponding splines on the body interior and the output shaft exterior. The piston sleeve is reciprocally mounted within the body and has a piston head portion for the application of fluid pressure to one or the other opposing sides thereof to produce axial movement of the piston sleeve.

As the piston sleeve linearly reciprocates in an axial direction within the body, outer helical splines of the sleeve portion engage helical splines of the body to cause rotation of the sleeve portion. The resulting linear and rotational movement of the sleeve portion is transmitted through inner helical splines of the sleeve portion to helical splines of the shaft to cause the shaft to rotate. Bearings are typically supplied to rotatably support one or both ends of the shaft relative to the body.

Reducing the time and cost of manufacturing fluid-powered rotary actuators and their length are two always present challenges. As shown in U.S. Pat. Nos. 4,313,367 and 5,054,372, in the past the actuator shaft has been designed with a helically splined wall portion which is engaged by the inner helical splines of the sleeve portion of the piston sleeve, and a smooth wall portion that is sealably engaged by the piston head portion of the piston sleeve. With the actuators disclosed in these patents the shaft splines may be cut directly into the shaft, or a helically splined collar can be welded to the shaft to provide the splines of the shaft. Cutting the splines directly into the solid steel shaft is preferred since it eliminates the extra steps and the cost of fabricating a splined collar, pressing the collar into place on the shaft, welding the collar to the shaft, and then performing additional machining to make sure the collar is in true concentric alignment with the shaft. Also avoided are the preparation steps needed to prepare the shaft and the collar for welding, the inherent weakness and susceptibility to failure of a welded attachment, and the possibility of loss of heat treatment and torque carrying ability in the area of the shaft that is heated during the act of welding. It is noted that in the past the splined wall portion of the shaft has been manufactured with a larger diameter than the smooth wall portion of the shaft. In this fashion, larger diameter splines (gears) are provided, and the reduced diameter shaft smooth wall portion allows use of a larger size piston, both of which increase the torque output of the actuator.

Cutting the splines directly into the shaft is difficult when the shaft is designed with an integral flange portion such as shown in U.S. Pat. Nos. 4,683,767 and 4,906,161, or a flange that is welded in place before the splines are cut. Accurate and efficient cutting of the splines immediately adjacent to the flange is difficult, if they are possible to cut at all using the typical Hobbing or Shaping cutters used to cut splines. The result is a space without splines located between the flange and the end cut or run out area of the splines where the cutter cannot reach. This produces an increased shaft length and hence an increased length actuator. To eliminate this space between the flange and the spline end cuts, and thus reduce the length of the actuator, splined collars have been used. The collar has splines cut therein before assembly on the shaft. The collar can be pressed into position immediately adjacent to the flange and then welded to the shaft. The use of the collar increases the time and cost of manufacturing the actuator, and possibly weakens the actuator's torque carrying ability.

When using bearing blocks to rotatably support the shaft relative to the body, cutting splines directly in the shaft can increase the length of the shaft so as to accommodate the axial positioning of the bearing blocks. As shown in U.S. Pat. No. 5,267,504, the splines are cut directly into the shaft. To avoid increasing the length of the shaft and hence the actuator, the bearing blocks are axially located on the shaft in a position overlaying the run out area for the splines produced by the cutter used. While this keeps the length of the shaft shorter than if the bearing blocks were not placed over the spline run out area, the placement can cause a problem since it could weaken the actuator's torque carrying ability. This problem can be avoided by use of overhung bearings.

Overhung bearings have a bearing support which provides an annular recess between the bearing support and the shaft into which a corresponding end portion of the piston sleeve can move as it travels to its end limit of travel within the body, thus requiring no additional axial length of the shaft to accommodate the overhung bearing. The resulting shaft length is thereby reduced compared to the length required for use of bearing blocks. Such overhung bearings are rigidly attached to the shaft flange, and preferably formed as an integral unit with the shaft flange. Another overhung bearing is used at the opposite end of the shaft. The overhung bearings are supported radially spaced apart from the shaft's splined wall portion at one end and from the shaft's smooth wall portion at the other shaft end to provide annular recesses which receive the piston sleeve end portions therein as the piston sleeve moves into its end limit of axial travel within the body. The use of overhung bearings avoids the positioning of bearing blocks over the spline run out area.

While overhung bearings help reduce the length of the shaft by providing annular recesses that receive the end portions of the piston sleeve therein, their benefit is lessened when used with a shaft flange since they make cutting of the splines immediately adjacent to the shaft flange even more difficult. Usually the cutter used cannot fit within the annular recess provided between the bearing support and the adjacent shaft wall into which the splines are typically cut. Thus, the splines are cut even axially farther from the shaft flange than when bearing blocks are used, and the shaft must be made longer to do so, thus offsetting some of the shaft length reduction of using overhung bearings.

The problems and benefits discussed above when using splines are generally the same when the grooves cut into the shaft to facilitate transfer of torque between the shaft and the piston sleeve are for balls, rollers or disks.

It will be therefore be appreciated that there has long been a significant need for fluid-powered rotary actuators that require less time and cost to manufacture, and that have a reduced length. The present invention fulfills these needs and further provides other related advantages.

SUMMARY OF THE INVENTION

The present invention resides in a fluid-powered rotary actuator for providing rotational movement between first and second external members. The actuator includes a body having a longitudinal axis, and first and second ends, and a drive member extending longitudinally and generally coaxially within the body. The body has an interior sidewall portion with a grooved, inwardly facing circumferential portion. The body is adapted for coupling to the first external member.

The drive member is supported for rotation relative to the body. The drive member has an end flange positioned toward the body first end adapted for coupling to the second external member to provide the rotational movement between the first and second external members. A shaft is rigidly connected to the end flange. The shaft has a grooved, outwardly facing circumferential sidewall portion positioned within the body toward the body second end and a smooth, outwardly facing circumferential sidewall portion positioned within the body between the end flange and the shaft grooved sidewall portion. The end flange extends laterally outward beyond the shaft smooth sidewall portion. In a preferred embodiment, the shaft grooved sidewall portion has an outer diameter equal to or less than an outer diameter of the shaft smooth sidewall portion. The drive member and the body define an annular space therebetween. The shaft grooved sidewall portion is formed as an integral portion of the shaft.

The actuator further includes a piston positioned generally coaxially within the body in the annular space. The piston is mounted for reciprocal axial movement within the body in response to selective application of pressurized fluid thereto. The piston is in sliding sealed engagement with the shaft smooth sidewall portion and the body interior sidewall portion to define fluid compartments to each side thereof for the selective application of pressurized fluid thereto to move the piston toward the body first end or to move the piston toward the body second end.

A torque transmitting member is positioned generally coaxially within the body and mounted for reciprocal axial movement within the body. The torque transmitting member engages the shaft grooved sidewall portion and the body grooved sidewall portion as the piston reciprocally moves within the body to translate axial movement of the piston toward the body first end into one of clockwise or counterclockwise relative rotational movement between the drive member and the body, and the axial movement of the piston toward the body second end into the other of clockwise or counterclockwise relative rotational movement between the drive member and the body. In a preferred embodiment, the piston and the torque transmitting member form an annular piston sleeve.

In the preferred embodiment, the end flange and the shaft are formed as an integral unit. Further, the shaft grooved sidewall portion has an outer diameter equal to or less than an outer diameter of the shaft smooth sidewall portion.

In the preferred embodiment, the piston sleeve has a central aperture receiving the shaft therethrough. An axially extending portion of the central aperture extends through a piston portion of the piston sleeve having an inner diameter greater than the outer diameter of the shaft smooth sidewall portion. As such, on assembly of the actuator the piston portion of the piston sleeve can be received onto the shaft from an end thereof away from the end flange with the piston freely passing over the shaft grooved sidewall portion and into position for sliding sealed engagement with the shaft smooth sidewall portion.

The actuator can be constructed to further include an annular beating support rigidly attached to the end flange and positioned generally coaxially within the body in the annular space. The bearing support has an outwardly facing circumferential sidewall portion supporting a bearing in engagement with the body interior sidewall and an inwardly facing circumferential sidewall portion extending circumferentially about the shaft smooth sidewall portion and spaced laterally outward apart from the shaft smooth sidewall portion to define an annular piston sleeve recess therebetween. The piston sleeve recess is sized to receive an end portion of the piston sleeve toward the body first end therein as the piston sleeve moves toward the body first end. As such, the bearing and the piston sleeve end portion are in overlapping relation when the piston sleeve is moved toward the body first end to allow use of a reduced length shaft.

Other features and advantages of the invention will become apparent from the following detailed description, taken in conjunction with the accompanying drawings.

DETAILED DESCRIPTION OF THE INVENTION

Figure 1:
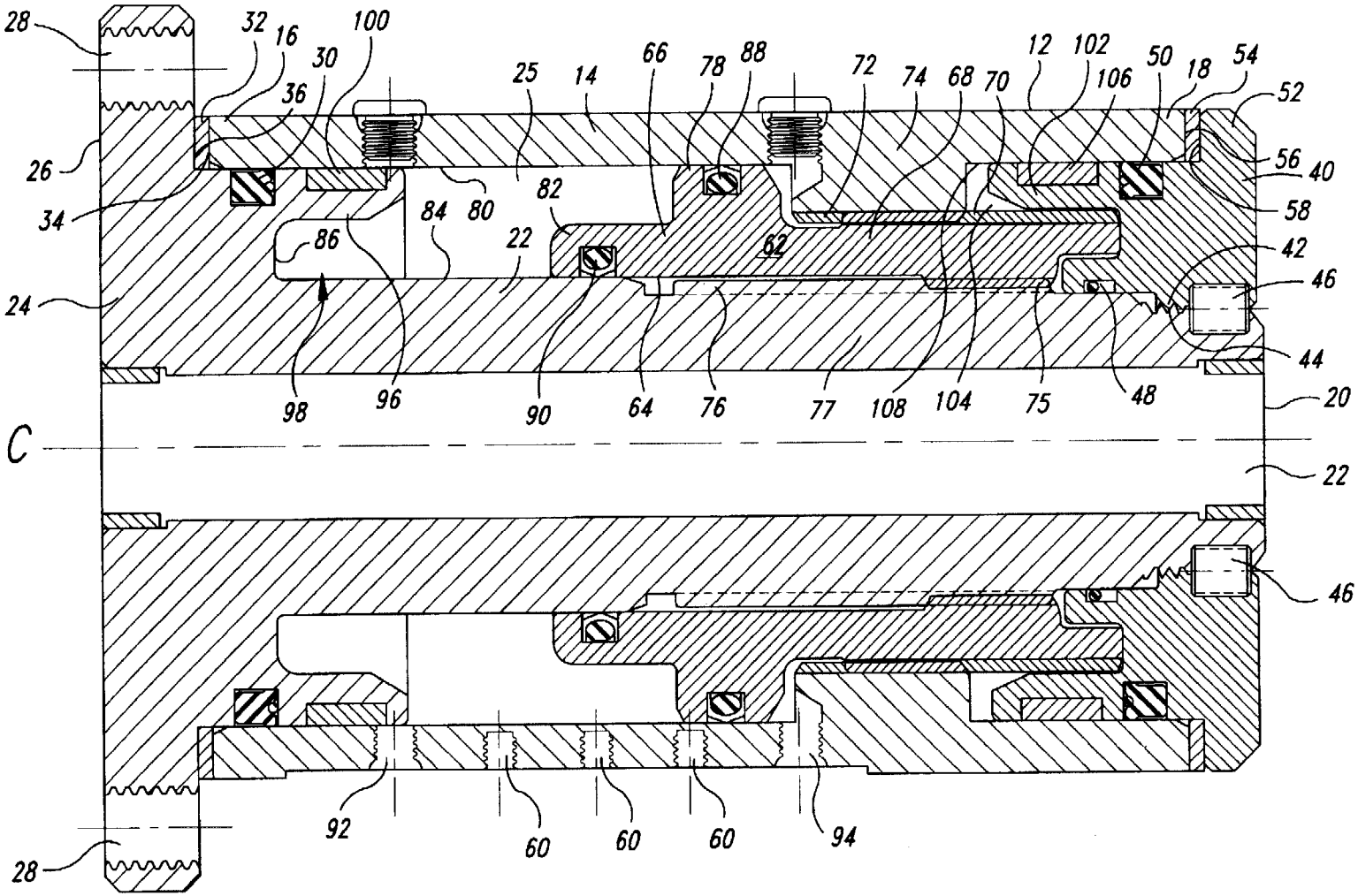
FIG. 1 is a side elevational, sectional view of a fluid-powered rotary splined actuator embodying the present invention.

As shown in the drawings for purposes of illustration, the present invention is embodied in a fluid-powered rotary actuator 10. A first embodiment of the actuator 10 is shown in FIG. 1. The actuator 10 includes an elongated housing or body 12 having a cylindrical sidewall 14 and first and second ends 16 and 18, respectively. A rotary output drive member 20 is coaxially positioned within the body 12 and supported for rotation relative to the body, as well as described in more detail below.

The drive member 20 includes an elongated shaft 22 coaxially extending substantially the full length of the body 12 and a radially outward projecting end flange 24. The shaft 22 and the end flange 24 are formed as an integral unit such as from a single piece of machined stock or a machined forging. The shaft 22 and the body sidewall 14 define an annular space 25 therebetween within the body 12. The shaft 22 has a generally circular cross-section. The drive member 20 has a hollow center bore 27 extending the full length thereof.

The end flange 24 is positioned at the body first end 16 and extends laterally or radially outward beyond the sidewall 14 at the body first end 16 to provide a flat and circular outwardly facing mounting surface 26 which can be attached to an external device (not shown) to be rotated relative to the body 12. The end flange 24 has a plurality of outwardly opening threaded holes 28 circumferentially spaced thereabout away from a central rotational axis "C" of the drive member 20 for coupling to the external device by a plurality of fastening bolts (not shown). The shaft 22 may be coupled to the external device in other known ways, as is desirable for the intended use of the actuator 10. A seal 30 is disposed between the end flange 24 and the body sidewall 14 toward the body first end 16 to provide a fluid-tight seal therebetween. A thrust bearing ring 32 is disposed between an axial end wall 34 of the body sidewall 14 at the body first end 16 and an axially inward facing portion 36 of the end flange 24 to reduce drag on rotation of the drive member 20 and to limit axial movement of the drive member toward the body second end 18.

As is conventional, the body 12 and the drive member 20 are constructed to be generally symmetrical about the rotational axis "C." It is to be understood that the invention may be practiced with the drive member 20 rotatably driving an external device, or with the drive member being held stationary and the rotational drive being provided by rotation of the body 12.

The shaft 22 has an annular carrier or shaft nut 40 threadably attached thereto toward the body second end 18. The shaft nut 40 has a threaded interior portion 42 threadably attached to a correspondingly threaded perimeter portion 44 of the shaft 22. The shaft nut 40 is locked in place on the shaft 22 against rotation by set screws 46. A seal 48 is disposed between the shaft nut 40 and the shaft 22 to provide a fluid-tight seal therebetween, and a seal 50 is disposed between the shaft nut 40 and the body sidewall 14 to provide a fluid-tight seal therebetween. The shaft nut 40 has a flange 52 which extends laterally or radially outward beyond the body sidewall 14 at the body second end 18. A thrust bearing ring 54 is disposed between an axial end wall 56 of the body sidewall 14 at the body second end 18 and an axially inward facing portion 58 of the flange 52 to reduce drag on rotation of the drive member 20 and to limit axial movement of the drive member toward the body first end 16.

The body 12 has threaded attachment holes 60 for attachment of the body 12 to a support frame (not shown) or other external device to which the body is to be mounted.

The actuator 10 has a linear-to-rotary transmission means which includes an annular piston sleeve 62 which is reciprocally mounted within the body 12 in the annular space 25 coaxially about the shaft 22 and the rotational axis C. The piston sleeve 62 has a central aperture 64 which receives the shaft 22 therethrough. The piston sleeve has an annular piston portion 66 and an annular sleeve portion 68 in coaxial alignment. The sleeve portion 68 has outer helical splines 70 over a portion of its length toward the body second end 18 which mesh with inner helical splines 72 of a ring gear portion 74 of the body sidewall 14 positioned toward the body second end 18. The ring gear portion 74 of the body sidewall 14 can also be fabricated as a separate ring gear member pinned or welded to the body sidewall, rather than formed as an integral portion of the body sidewall as is shown in FIG. 1.

The sleeve portion 68 is also provided within inner helical splines 75 over a portion of its length toward the body second end 18 which mesh with outer helical splines 76 provided on a splined portion 77 of the shaft 22 toward the body second end 18. It should be understood that while helical splines are shown in the drawings and described herein, the principal of the invention is equally applicable to any form of linear-to-rotary motion conversion means, such as balls, rollers or disks.

The piston portion 66 of the piston sleeve 62 is positioned toward the end of the piston sleeve, toward the body first end 18. The piston sleeve 62 is slidably maintained within the body 12 for reciprocal movement, and undergoes longitudinal and rotational movement relative to the body sidewall 14, as will be described in more detail below.

The piston portion 66 has a circumferential outer portion 78 which slidably engages a smooth, inwardly facing circumferential wall surface 80 of the body sidewall 14, and a circumferential inner portion 82 which slidably engages a smooth, outwardly facing circumferential wall surface 84 of the shaft 22. In accordance with one aspect of the present invention, the shaft smooth wall surface 84 is positioned between the end flange 24 and the outer helical splines 76 formed on the splined portion 77 of the shaft 22. This is unlike conventional flanged shaft designs which cut the splines adjacent to the shaft flange, and between the shaft flange and the shaft smooth wall surface engaged by the piston portion of the piston sleeve. The shaft smooth wall surface 84 extends in the direction of the body first end 16 fully to a laterally outward extending wall 86 of the end flange 24 within the body 12 and facing toward the body second end 18. By positioning the shaft smooth wall surface 84 adjacent to the end flange 24 and the splined portion 77 of the shaft 22 toward the body second end 18, at the opposite shaft end from the end flange, the shaft splines 76 can be more accurately and efficiently cut directly into the shaft splined portion without the need to use a splined collar welded to the shaft. The problems encountered in the past associated with attempting to cut splines close to the shaft flange are avoided, and a shorter shaft, and hence actuator, results.

The outer portion 78 of the piston portion 66 of the piston sleeve 62 carries a seal 88 which is disposed between the piston portion 66 and the smooth interior wall surface 80 of the body sidewall 14 to provide a fluid-tight seal therebetween. The smooth interior wall surface 80 of the body sidewall 14 is positioned between the body first end 16 and the ring gear portion 74 of the body sidewall, generally opposite and partially axially coextensive with the shaft smooth wall surface 84. The inner portion 82 of the piston portion 66 carries a seal 90 which is disposed between the piston portion 66 and the smooth exterior wall surface 84 of the shaft 22 to provide a fluid-tight seal therebetween.

As will be readily understood, reciprocation of the piston portion 66 of the piston sleeve 62 within the annular space 25 in the body 12 occurs when hydraulic oil, air or any other suitable fluid under pressure selectively enters through a first port 92 to one side of the piston portion toward the body first end 16 or through a second port 94 to the other side of the piston portion toward the body second end 18. As the piston portion 66, and the sleeve portion 68 rigidly attached thereto and of which the piston portion is an integral part, linearly reciprocates in an axial direction within the body 12, the outer helical splines 70 of the sleeve portion 68 engage or mesh with the inner helical splines 72 of the ring gear portion 74 of the body sidewall 14 to cause rotation of the piston sleeve 62. The linear and rotational movement of the piston sleeve 62 is transmitted through the inner helical splines 74 of the sleeve portion 68 to the outer helical splines 76 of the splined portion 77 of the shaft 22 to cause the shaft and the entire drive member 20 to rotate. The longitudinal movement of the shaft 22 is restricted, thereby converting all movement of the piston sleeve 62 into rotational movement of the shaft 22. Depending on the slope and direction of turn of the various helical splines, there may be provided a multiplication of the rotary output of the shaft 22. It is to be noted that one of the meshing sets of splines need not be helical to still produce rotary motion between the shaft 22 and the body 12.

The application of fluid pressure to the port 92 produces axial movement of the piston sleeve 62 toward the body second end 18. The application of fluid pressure to the port 94 produces axial movement of the piston sleeve 62 toward the body first end 16. The actuator 10 provides relative rotational movement between the body 12 and the shaft 22 (and drive member 20) through the conversion of linear movement of the piston sleeve 62 into rotational movement of the shaft, in a manner well known in the art.

To allow for assembly of the actuator 10, particularly the piston sleeve 62 onto the shaft 22, from the end of the shaft toward the body second end 18 (the opposite shaft end from the end flange 24), the splines 76 of the shaft splined portion 77 have an outer diameter somewhat less than the outer diameter of the shall smooth wall surface 84. In such fashion, the portion of the central aperture 64 of the piston sleeve 68, along the length of the inner portion 82 of piston portion 66, which has an inner diameter slightly greater than the outer diameter of the shaft smooth wall surface 84, can pass unimpeded over the smaller outer diameter splines 76 of the shaft splined portion on assembly of the piston sleeve onto the shaft 22 from the end thereof toward the body second end 18.

The actuator 10 includes an overhung bearing support 96 rigidly attached to the wall 86 of the end flange 24 and projecting axially inward toward the body second end 18. The bearing support 96 is formed as an integral part of the end flange 24. A circumferential recess 98 is defined between the bearing support 96 and the smooth wall surface 84 of the shaft 22 and sized to receive therein an axially outward end portion of the inner portion 82 of the piston portion 66 when the piston sleeve 62 has almost reached its end limit of travel toward the body first end 16. When in the circumferential recess 98, the end portion of the piston sleeve 62 is overlapping the bearing support 98. As such, the travel of the piston sleeve 62 is not impeded by the bearing support 96 and the length of the shaft 22 does not need to be increased to accommodate the bearing support. A bearing 100 is positioned in a circumferential groove in an outwardly facing circumferential sidewall of the bearing support 96 to slidably engage the smooth interior wall surface 80 of the body sidewall 14 and support the drive member 20 for rotation relative to the body 12 against radial loads.

Similarly, an overhung bearing support 102 is rigidly attached to the shaft nut 40 and projects axially inward toward the body first end 16. The bearing support 102 is formed as an integral part of the shaft nut 40. A circumferential recess 104 is defined between the bearing support 102 and the splined portion 77 of the shaft 22 and sized to receive therein an axially outward end portion of the sleeve portion 68 of the piston sleeve 62 when the piston sleeve has almost reached its end limit of travel toward the body second end 18. When in the circumferential recess 104, the end portion of the piston sleeve 62 is overlapping the bearing support 102. As such, the travel of the piston sleeve 62 is not impeded by the bearing support 102 and the length of the shaft 22 does not need to be increased to accommodate the bearing support. A beating 106 is positioned in a circumferential groove in an outwardly facing circumferential sidewall of the bearing support 102 to slidably engage a smooth interior wall surface 108 of the body sidewall 14 located between the ring gear portion 74 of the body sidewall and the body second end 18 and support the drive member 20 for rotation relative to the body 12 against radial loads.

By using the bearing supports 96 and 102, and the corresponding circumferential recesses 98 and 104 they provide, the axial length of the shaft 22, and hence the body 12, is reduced, while permitting the full length stroke of the piston sleeve 62 within the body 12.

In accordance with another aspect of the invention, the drive member 20 of the actuator 10 is fabricated by forming the shaft 22 and the end flange 24 as an integral unit with the end flange rigidly connected to the shaft to improve the torque carrying ability of the actuator and reduce the time and cost of its manufacture. By not welding the end flange to the shaft, the drive member has a stronger design. Since the shaft is made of heat treated steel, avoiding welding eliminates many problems.

Next, the splines 76 are cut directly into the splined portion 77 of the shaft 22 at its end away from the end flange 24 and toward the body second end 18 when the actuator 10 is assembled. No separate splined collar is used. The smooth exterior wall surface 84 of the shaft is also provided between the end flange 24 and the splined portion 77, thus spacing the splined portion 77 sufficiently far from the end flange 24 to minimize or eliminate its interference with the cutting of the splines 76 of the splined portion 77. By not cutting splines into the shaft 22 in the area adjacent to the end flange 24, but at a relatively large distance therefrom, the portion of the drive member 20 whereat the shaft 22 and the end flange 24 are attached together has more material present and thus is stronger. Without use of a splined collar welded to the shaft, the strength of the drive member 20 is increased. After fabrication of the drive member 20 and the piston sleeve 62, the piston sleeve can be assembled onto the shaft 22 by sliding it over and along the shaft from the end of the shaft away from the end flange 24.

Figure 2:
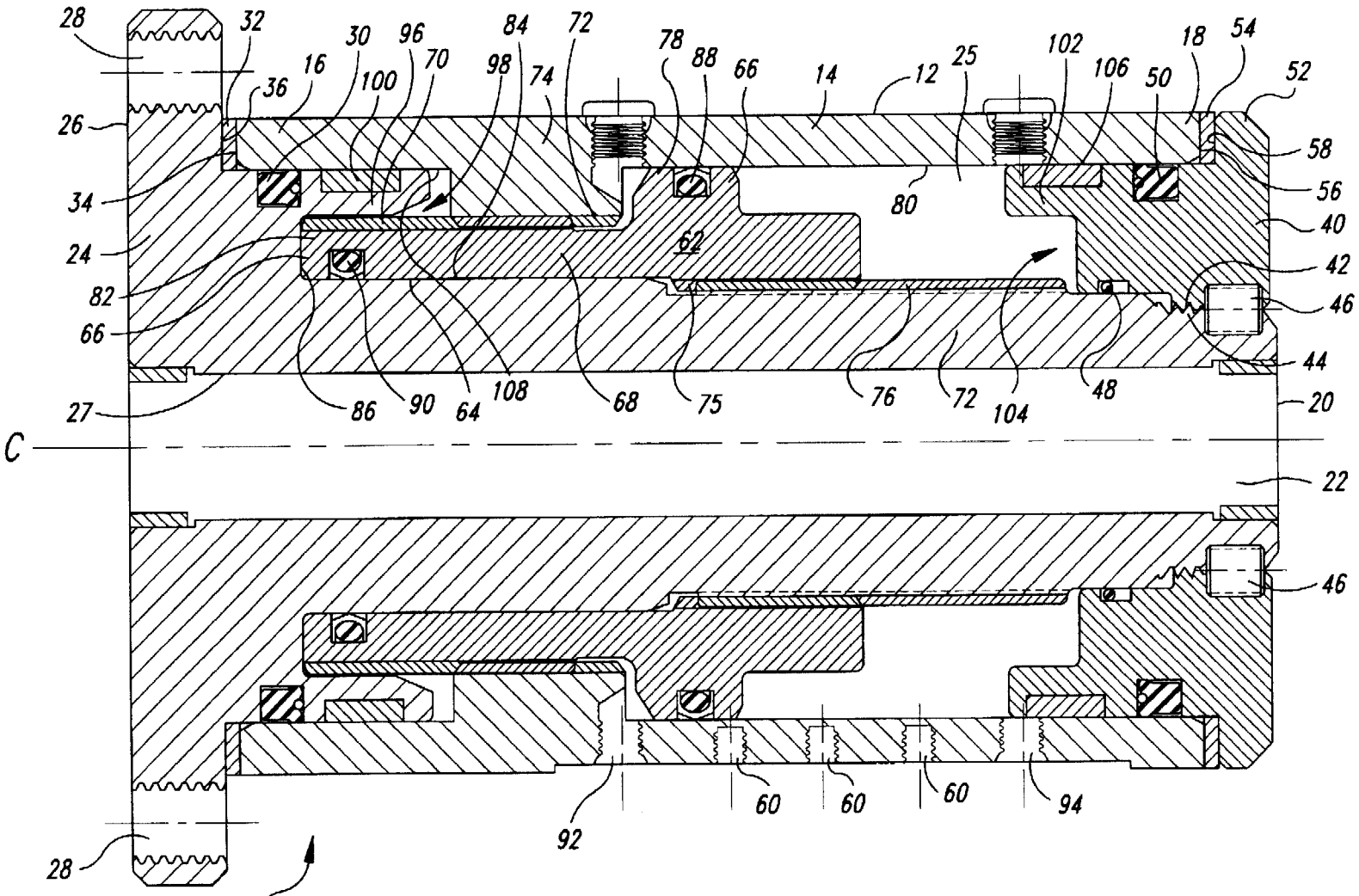
FIG. 2 is a side elevational, sectional view of an alternative embodiment of a fluid-powered rotary splined actuator embodying the present invention.

An alternative embodiment of the actuator 10 is illustrated in FIG. 2. For ease of understanding, the components of the alternative embodiment will be similarly numbered with those of the embodiment of FIG. 1 when of a similar construction. Only the more significant differences in construction will be described.

In the embodiment of FIG. 2, the outer portion 78 of the piston portion 66 is located toward the end of the piston sleeve 62 toward the body second end 18. Correspondingly, the smooth interior wall surface 80 of the body sidewall 14 is located between the ring gear portion 74 of the body sidewall and the body second end 18. In this embodiment, the bearing 106 supported by the bearing support 102 slidably engages the smooth interior wall surface 80 of the body sidewall 14, while the bearing 100 of the bearing support 96 slidably engages the smooth interior wall surface 108 of the body sidewall which is positioned between the body first end 16 and the ring gear portion 74 of the body sidewall 14. The ring gear portion 74 is opposite the shaft smooth wall surface 84. In this embodiment the smooth interior wall surface 108 is located between the ring gear portion 74 and the body first end 16. The position of the ring gear portion 74 is also shifted more towards the body first end 16 in the embodiment of FIG. 2. Except for these distinctions, the alternative embodiment of the actuator 10 shown in FIG. 2 is of the same construction and operation as described above for the actuator of FIG. 1.

It is to be noted that, while not shown in the illustrated embodiments of the actuator 10, the seal 90 which is carded by the inner portion 82 of the piston portion 66 can be disposed in a circumferential groove in the shaft 22 rather than carried by the piston sleeve 62. In such a fashion, the seal 90 would be provided with an axially stationary position rather than moving with the reciprocating piston sleeve 62.

Figure 3:
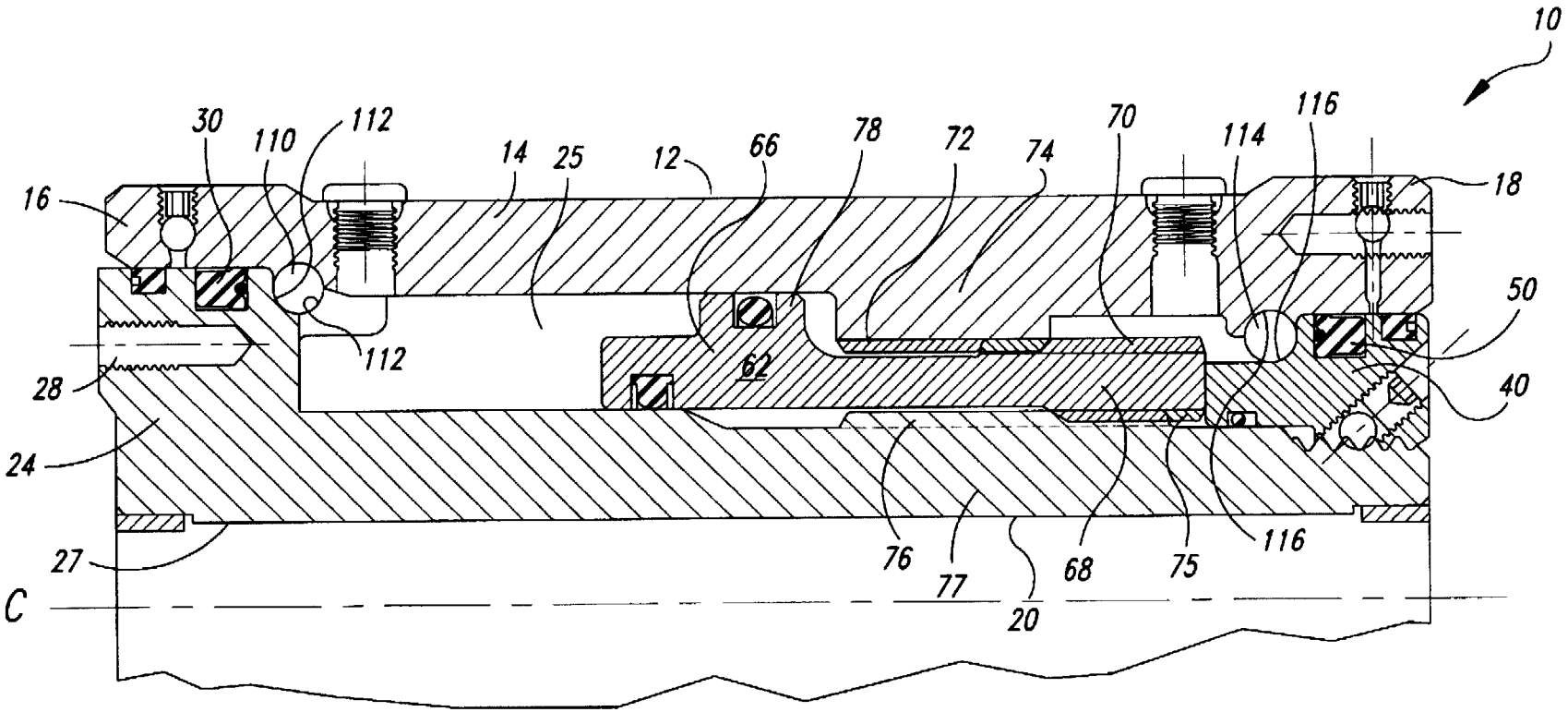
FIG. 3 is a fragmentary side elevational, sectional view of a second alternative embodiment of a fluid-powered rotary splined actuator embodying the present invention.
Figure 4:
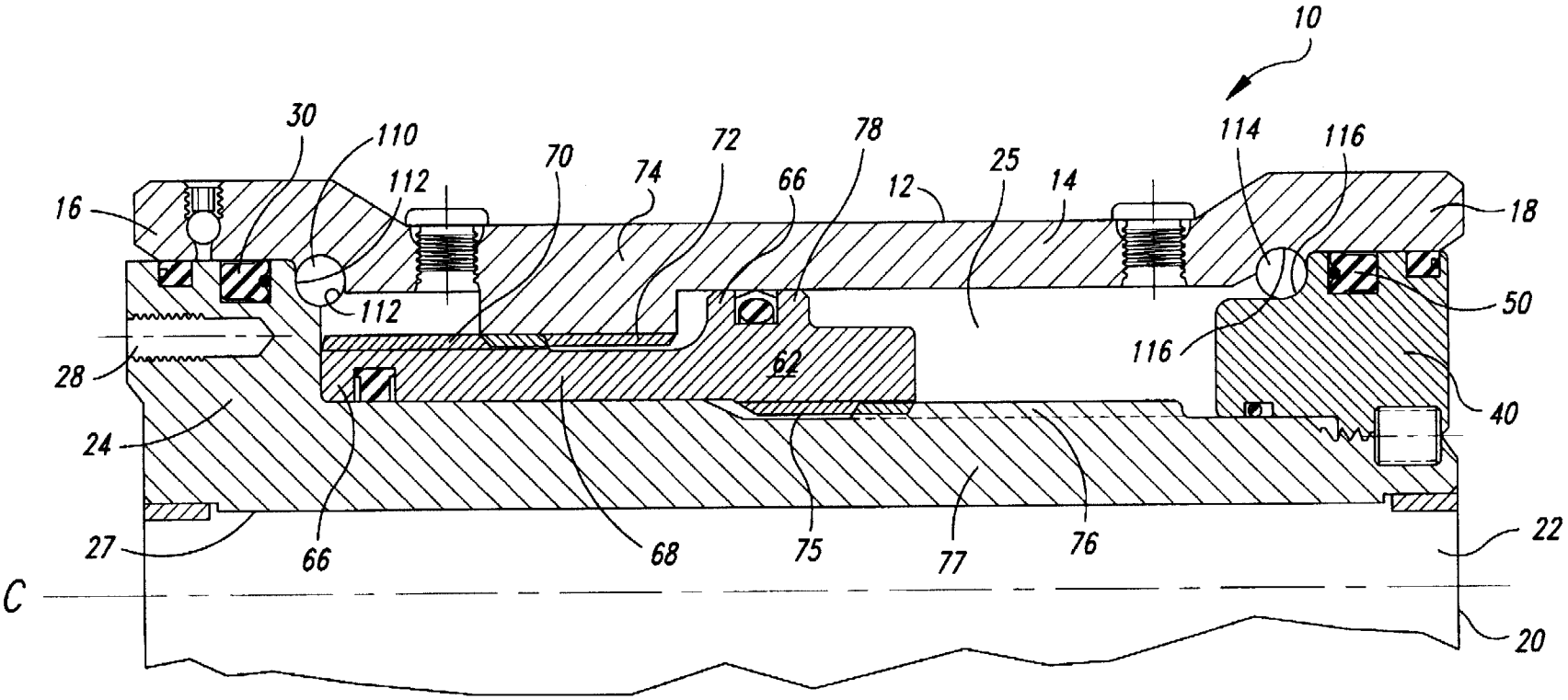
FIG. 4 is a fragmentary side elevational, sectional view of a third alternative embodiment of a fluid-powered rotary splined actuator embodying the present invention.

Second and third alternative embodiments of the actuator 10 are illustrated in FIGS. 3 and 4. In these embodiments the thrust bearing rings 32 and 54 and the bearings 100 and 106 are replaced with a plurality of ball bearings 110 residing in confronting and corresponding ball bearing races 112 formed in the end flange and the body sidewall 14 toward the body first end 16, and a plurality of ball bearings 114 residing in confronting and corresponding ball races 116 formed in the shaft nut 40 and the body sidewall 14 toward the body second end 18. As such, the overhang bearing supports 96 and 102 are not utilized.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered rotary actuator for providing rotational movement between first and second external members, comprising:

a body having a longitudinal axis, and first and second ends, said body having a generally cylindrical interior sidewall portion with a grooved, inwardly facing circumferential portion, said body being adapted for coupling to the first external member;

a drive member extending generally coaxially within said body and supported for rotation relative thereto, said drive member being adapted for coupling to the second external member to provide the rotational movement between the first and second external members, said drive member having an end flange positioned toward said body first end and a shaft rigidly connected thereto, said shaft having a grooved, outwardly facing circumferential sidewall portion positioned within said body toward said body second end and a smooth, outwardly facing circumferential sidewall portion positioned within said body between said end flange and said shaft grooved sidewall portion, said end flange extending laterally outward beyond said shaft smooth sidewall portion and said shaft grooved sidewall portion having an outer diameter equal to or less than an outer diameter of said shaft smooth sidewall portion, said drive member and said body defining an annular space therebetween, said shaft grooved sidewall portion being formed as an integral portion of said shaft; and an annular piston sleeve having a piston portion and a sleeve portion positioned generally coaxially within said body in said annular space, said piston sleeve having a central aperture receiving said shaft therethrough, said piston sleeve being mounted for reciprocal axial movement within said body in said annular space in response to selective application of pressurized fluid to said piston portion, said piston portion being in sliding sealed engagement with said shaft smooth sidewall portion and said body interior sidewall portion to define fluid compartments to each side thereof for the selective application of pressurized fluid thereto to move said piston sleeve toward said body first end or to move said piston sleeve toward said body second end, said sleeve portion having a grooved, inwardly facing circumferential sidewall portion engaging said shaft grooved sidewall portion as said piston sleeve reciprocally moves within said body, and a grooved, outwardly facing circumferential sidewall portion engaging said body grooved sidewall portion as said piston sleeve reciprocally moves within said body to translate said axial movement of said piston sleeve toward said body first end into one of clockwise or counterclockwise relative rotational movement between said drive member and said body and said axial movement of said piston sleeve toward said body second end into the other of clockwise or counterclockwise relative rotational movement between said drive member and said body.

2. The fluid-powered rotary actuator of claim 1 wherein said end flange and said shaft comprise an integral unit.

3. The fluid-powered rotary actuator of claim 1, further including an annular bearing support rigidly attached to said end flange and positioned generally coaxially within said body in said annular space, said bearing support having an outwardly facing circumferential sidewall portion supporting a bearing in engagement with said body interior sidewall and an inwardly facing circumferential sidewall portion extending circumferentially about said shaft smooth sidewall portion and spaced laterally outward apart from said shaft smooth sidewall portion to define an annular piston sleeve recess therebetween sized to receive an end portion of said piston sleeve toward said body first end therein as said piston sleeve moves toward said body first end, whereby said bearing and said piston sleeve end portion are in overlapping positions when said piston sleeve is moved toward said body first end to allow use of a reduced length shaft.

4. A fluid-powered rotary actuator for providing rotational movement between first and second external members, comprising:

a body having a longitudinal axis, and first and second ends, said body having an interior sidewall portion with a grooved, inwardly facing circumferential portion, said body being adapted for coupling to the first external member;

a drive member extending generally coaxially within said body and supported for rotation relative thereto, said drive member being adapted for coupling to the second external member to provide the rotational movement between the first and second external members, said drive member having an end flange positioned toward said body first end and a shaft rigidly connected thereto, said shaft having a grooved, outwardly facing circumferential sidewall portion positioned within said body toward said body second end and a smooth, outwardly facing circumferential sidewall portion positioned within said body between said end flange and said shaft grooved sidewall portion, said end flange extending laterally outward beyond said shaft smooth sidewall portion and said shaft grooved sidewall portion having an outer diameter equal to or less than an outer diameter of said shaft smooth sidewall portion, said drive member and said body defining an annular space therebetween, said shaft grooved sidewall portion being formed as an integral portion of said shaft;

a piston positioned generally coaxially within said body in said annular space and mounted for reciprocal axial movement within said body in response to selective application of pressurized fluid thereto, said piston being in sliding sealed engagement with said shaft smooth sidewall portion and said body interior sidewall portion to define fluid compartments to each side thereof for the selective application of pressurized fluid thereto to move said piston toward said body first end or to move said piston toward said body second end; and a torque-transmitting member positioned generally coaxially within said body and mounted for reciprocal axial movement within said body, said torque-transmitting member engaging said shaft grooved sidewall portion and said body grooved sidewall portion as said piston reciprocally moves within said body to translate said axial movement of said piston toward said body first end into one of clockwise or counterclockwise relative rotational movement between said drive member and said body and said axial movement of said piston toward said body second end into the other of clockwise or counterclockwise relative rotational movement between said drive member and said body.

5. The fluid-powered rotary actuator of claim 4 wherein said end flange and said shaft comprise an integral unit.

6. The fluid-powered rotary actuator of claim 4 wherein said piston is annular and has said shaft extending therethrough, and the actuator further includes an annular bearing support rigidly attached to said end flange and positioned generally coaxially within said body in said annular space, said bearing support having an outwardly facing circumferential sidewall portion supporting a bearing in engagement with said body interior sidewall and an inwardly facing circumferential sidewall portion extending circumferentially about said shaft and spaced laterally outward apart from said shaft to define an annular recess therebetween sized to receive an end portion of said piston toward said body first end therein as said piston moves toward said body first end, whereby said bearing and said piston end portion are in overlapping positions when said piston is moved toward said body first end to allow use of a reduced length shaft.

7. A fluid-powered rotary actuator for providing rotational movement between first and second external members, comprising:

a body having a longitudinal axis, and first and second ends, said body having a generally cylindrical interior sidewall portion with a grooved, inwardly facing circumferential portion, said body being adapted for coupling to the first external member;

a drive member extending generally coaxially within said body and supported for rotation relative thereto, said drive member having an end flange positioned toward said body first end adapted for coupling to the second external member to provide the rotational movement between the first and second external members, and a shaft rigidly connected thereto, said end flange and said shaft being formed as an integral unit, said shaft having a grooved, outwardly facing circumferential sidewall portion positioned within said body toward said body second end and a smooth, outwardly facing circumferential sidewall portion positioned within said body between said end flange and said shaft grooved sidewall portion, said end flange extending laterally outward beyond said shaft smooth sidewall portion, said drive member and said body defining an annular space therebetween, said shaft grooved sidewall portion being formed as an integral portion of said shaft; and an annular piston sleeve having a piston portion and a sleeve portion positioned generally coaxially within said body in said annular space, said piston sleeve having a central aperture receiving said shaft therethrough, said piston sleeve being mounted for reciprocal axial movement within said body in said annular space in response to selective application of pressurized fluid to said piston portion, said piston portion being in sliding sealed engagement with said shaft smooth sidewall portion and said body interior sidewall portion to define fluid compartments to each side thereof for the selective application of pressurized fluid thereto to move said piston sleeve toward said body first end or to move said piston sleeve toward said body second end, said sleeve portion having a grooved, inwardly facing circumferential sidewall portion engaging said shaft grooved sidewall portion as said piston sleeve reciprocally moves within said body, and a grooved, outwardly facing circumferential sidewall portion engaging said body grooved sidewall portion as said piston sleeve reciprocally moves within said body to translate said axial movement of said piston sleeve toward said body first end into one of clockwise or counterclockwise relative rotational movement between said drive member and said body and said axial movement of said piston sleeve toward said body second end into the other of clockwise or counterclockwise relative rotational movement between said drive member and said body.

8. The fluid-powered rotary actuator of claim 7, further including an annular bearing support rigidly attached to said end flange and positioned generally coaxially within said body in said annular space, said bearing support having an outwardly facing circumferential sidewall portion supporting a bearing in engagement with said body interior sidewall and an inwardly facing circumferential sidewall portion extending circumferentially about said shaft smooth sidewall portion and spaced laterally outward apart from said shaft smooth sidewall portion to define an annular piston sleeve recess therebetween sized to receive an end portion of said piston sleeve toward said body first end therein as said piston sleeve moves toward said body first end, whereby said bearing and said piston sleeve end portion are in overlapping positions when said piston sleeve is moved toward said body first end to allow use of a reduced length shaft.

9. A fluid-powered rotary actuator for providing rotational movement between first and second external members, comprising:

a body having a longitudinal axis, and first and second ends, said body having an interior sidewall portion with a grooved, inwardly facing circumferential portion, said body being adapted for coupling to the first external member;

a drive member extending generally coaxially within said body and supported for rotation relative thereto, said drive member being adapted for coupling to the second external member to provide the rotational movement between the first and second external members, said drive member having an end flange positioned toward said body first end and a shaft rigidly connected thereto, said end flange and said shaft being formed as an integral unit, said shaft having a grooved, outwardly facing circumferential sidewall portion positioned within said body toward said body second end and a smooth, outwardly facing circumferential sidewall portion positioned within said body between said end flange and said shaft grooved sidewall portion, said end flange extending laterally outward beyond said shaft smooth sidewall portion, said drive member and said body defining an annular space therebetween, said shaft grooved sidewall portion being formed as an integral portion of said shaft;

a piston positioned generally coaxially within said body in said annular space and mounted for reciprocal axial movement within said body in response to selective application of pressurized fluid thereto, said piston being in sliding sealed engagement with said shaft smooth sidewall portion and said body interior sidewall portion to define fluid compartments to each side thereof for the selective application of pressurized fluid thereto to move said piston toward said body first end or to move said piston toward said body second end; and a torque-transmitting member positioned generally coaxially within said body and mounted for reciprocal axial movement within said body, said torque-transmitting member engaging said shaft grooved sidewall portion and said body grooved sidewall portion as said piston reciprocally moves within said body to translate said axial movement of said piston toward said body first end into one of clockwise or counterclockwise relative rotational movement between said drive member and said body and said axial movement of said piston toward said body second end into the other of clockwise or counterclockwise relative rotational movement between said drive member and said body.

10. The fluid-powered rotary actuator of claim 9, further including an annular bearing support rigidly attached to said end flange and positioned generally coaxially within said body in said annular space, said bearing support having an outwardly facing circumferential sidewall portion supporting a bearing in engagement with said body interior sidewall and an inwardly facing circumferential sidewall portion extending circumferentially about said shaft and spaced laterally outward apart from said shaft to define an annular piston sleeve recess therebetween sized to receive an end portion of said piston sleeve toward said body first end therein as said piston sleeve moves toward said body first end, whereby said bearing and said piston sleeve end portion are in overlapping positions when said piston sleeve is moved toward said body first end to allow use of a reduced length shaft.

11. A fluid-powered rotary actuator for providing rotational movement between first and second external members, comprising:

a body having a longitudinal axis, and first and second ends, said body having a generally cylindrical interior sidewall portion with a grooved, inwardly facing circumferential portion, said body being adapted for coupling to the first external member;

a drive member extending generally coaxially within said body and supported for rotation relative thereto, said drive member being adapted for coupling to the second external member to provide the rotational movement between the first and second external members, said drive member having an end flange positioned toward said body first end and a shaft rigidly connected thereto, said end flange and said shaft being formed as an integral unit, said shaft having a grooved, outwardly facing circumferential sidewall portion positioned within said body toward said body second end and a smooth, outwardly facing circumferential sidewall portion positioned within said body between said end flange and said shaft grooved sidewall portion, said end flange extending laterally outward beyond said shaft smooth sidewall portion and said shaft grooved sidewall portion having an outer diameter equal to or less than an outer diameter of said shaft smooth sidewall portion, said drive member and said body defining an annular space therebetween, said shaft grooved sidewall portion being formed as an integral portion of said shaft; and an annular piston sleeve having a piston portion and a sleeve portion positioned generally coaxially within said body in said annular space, said piston sleeve having a central aperture receiving said shaft therethrough, said piston sleeve being mounted for reciprocal axial movement within said body in said annular space in response to selective application of pressurized fluid to said piston portion, said piston portion being in sliding sealed engagement with said shaft smooth sidewall portion and said body interior sidewall portion to define fluid compartments to each side thereof for the selective application of pressurized fluid thereto to move said piston sleeve toward said body first end or to move said piston sleeve toward said body second end, said sleeve portion having a grooved, inwardly facing circumferential sidewall portion engaging said shaft grooved sidewall portion as said piston sleeve reciprocally moves within said body, and a grooved, outwardly facing circumferential sidewall portion engaging said body grooved sidewall portion as said piston sleeve reciprocally moves within said body to translate said axial movement of said piston sleeve toward said body first end into one of clockwise or counterclockwise relative rotational movement between said drive member and said body and said axial movement of said piston sleeve toward said body second end into the other of clockwise or counterclockwise relative rotational movement between said drive member and said body, an axially extending portion of said central aperture extending through said piston portion of said piston sleeve having an inner diameter greater than said outer diameter of said shaft smooth sidewall portion, whereby on assembly of the actuator said piston portion of said piston sleeve can be received onto said shaft from an end thereof away from said end flange with said piston portion freely passing over said shaft grooved sidewall and into position for sliding sealed engagement with said shaft smooth sidewall portion.

12. The fluid-powered rotary actuator of claim 11, further including an annular bearing support rigidly attached to said end flange and positioned generally coaxially within said body in said annular space, said beating support having an outwardly facing circumferential sidewall portion supporting a bearing in engagement with said body interior sidewall and an inwardly facing circumferential sidewall portion extending circumferentially about said shaft smooth sidewall portion and spaced laterally outward apart from said shaft smooth sidewall portion to define an annular piston sleeve recess therebetween sized to receive an end portion of said piston sleeve toward said body first end therein as said piston sleeve moves toward said body first end, whereby said bearing and said piston sleeve end portion are in overlapping positions when said piston sleeve is moved toward said body first end to allow use of a reduced length shaft.

13. A fluid-powered rotary actuator for providing rotational movement between first and second external members, comprising:

a body having a longitudinal axis, and first and second ends, said body having a generally cylindrical interior sidewall portion with a grooved, inwardly facing circumferential portion, said body being adapted for coupling to the first external member;

a drive member extending generally coaxially within said body and supported for rotation relative thereto, said drive member being adapted for coupling to the second external member to provide the rotational movement between the first and second external members, said drive member having an end flange positioned toward said body first end and a shaft rigidly connected thereto, said end flange and said shaft being formed as an integral unit, said shaft having a grooved, outwardly facing circumferential sidewall portion positioned within said body toward said body second end and a smooth, outwardly facing circumferential sidewall portion positioned within said body between said end flange and said shaft grooved sidewall portion, said end flange extending laterally outward beyond said shaft smooth sidewall portion and said shaft grooved sidewall portion having an outer diameter equal to or less than an outer diameter of said shaft smooth sidewall portion, said drive member and said body defining an annular space therebetween, said shaft grooved sidewall portion being formed as an integral portion of said shaft;

an annular piston positioned generally coaxially within said body in said annular space, said piston having a central aperture receiving said shaft therethrough, said piston being mounted for reciprocal axial movement within said body in response to selective application of pressurized fluid thereto, said piston being in sliding sealed engagement with said shaft smooth sidewall portion and said body interior sidewall portion to define fluid compartments to each side thereof for the selective application of pressurized fluid thereto to move said piston toward said body first end or to move said piston toward said body second end, said central aperture having an inner diameter greater than said outer diameter of said shaft smooth sidewall portion, whereby on assembly of the actuator said piston can be received onto said shaft from an end thereof away from said end flange with said piston freely passing over said shaft grooved sidewall and into position for slidingly sealed engagement with said shaft smooth sidewall portion; and a torque-transmitting annular member positioned generally coaxially within said body in said annular space and mounted for reciprocal axial movement within said body, said torque-transmitting member engaging said shaft grooved sidewall portion and said body grooved sidewall portion as said piston reciprocally moves within said body to translate said axial movement of said piston toward said body first end into one of clockwise or counterclockwise relative rotational movement between said drive member and said body and said axial movement of said piston toward said body second end into the other of clockwise or counterclockwise relative rotational movement between said drive member and said body.

14. The fluid-powered rotary actuator of claim 13, further including an annular bearing support rigidly attached to said end flange and positioned generally coaxially within said body in said annular space, said bearing support having an outwardly facing circumferential sidewall portion supporting a bearing in engagement with said body interior sidewall and an inwardly facing circumferential sidewall portion extending circumferentially about said shaft smooth sidewall portion and spaced laterally outward apart from said shaft smooth sidewall portion to define an annular piston recess therebetween sized to receive an end portion of said piston toward said body first end therein as said piston moves toward said body first end, whereby said bearing and said piston end portion are in overlapping positions when said piston is moved toward said body first end to allow use of a reduced length shaft.

* * * * *